US006675620B1

(12) United States Patent
Heyll et al.

(10) Patent No.: US 6,675,620 B1
(45) Date of Patent: Jan. 13, 2004

(54) PROCESS FOR MANUFACTURING LARGE AREA SHEET METAL PARTS, IN PARTICULAR A BODY COMPONENT FOR A VEHICLE

(75) Inventors: Rolf Heyll, Renningen (DE); Robert Koehr, Neustadt (DE)

(73) Assignee: Dr. Ing. H.C.F. Porsche AG, Stuttgart (DE)

( * ) Notice: Subject to any disclaimer, the term of this patent is extended or adjusted under 35 U.S.C. 154(b) by 253 days.

(21) Appl. No.: 09/705,919

(22) Filed: Nov. 6, 2000

(30) Foreign Application Priority Data

Nov. 5, 1999 (DE) ..... 199 53 522

(51) Int. Cl.[7] ..... B21D 22/10; B21D 26/04
(52) U.S. Cl. ..... 72/57; 72/60; 72/466.8
(58) Field of Search ..... 72/56, 57, 60, 72/61, 63, 466.8

(56) References Cited

U.S. PATENT DOCUMENTS 4,045,986 A * 9/1977 Laycock et al. ..... 72/60
4,409,808 A * 10/1983 Festag et al. ..... 72/60
5,322,206 A 6/1994 Harada et al.
5,632,172 A * 5/1997 Kasmacher ..... 72/60
6,098,438 A * 8/2000 Fischer ..... 72/60

FOREIGN PATENT DOCUMENTS

| | | |
|---|---|---|
| DE | 19624036 | 12/1997 |
| DE | 19717953 | 10/1998 |
| JP | 59066939 | 4/1984 |
| JP | 05212463 | 8/1993 |
| JP | 06000545 | 1/1994 |

* cited by examiner

*Primary Examiner*—David Jones
(74) *Attorney, Agent, or Firm*—Crowell & Moring LLP

(57) ABSTRACT

A process for the manufacture of a large area sheet metal part, in particular a body component for a vehicle, from a flat blank, provides that one sided pressurization with an active medium in a forming tool gives the flat blank a prestretched preform, and that then the preform, removed from the forming tool, is formed into the final shape in a separate deep drawing tool.

21 Claims, 2 Drawing Sheets

PROCESS FOR MANUFACTURING LARGE AREA SHEET METAL PARTS, IN PARTICULAR A BODY COMPONENT FOR A VEHICLE

BACKGROUND AND SUMMARY OF THE INVENTION

This application claims the priority of German Patent Document 199 53 522.1, filed in Germany, Nov. 5, 1999, the disclosures of which is expressly incorporated by reference herein.

The invention relates to a process for the manufacture of a large area sheet metal part, in particular a body component for a vehicle, from a flat blank.

Large area body components, like vehicle roofs, outside door panels, side parts, outside cover plates or the like, are traditionally manufactured by deep drawing. Deep drawing takes place in hydraulic or mechanical drawing presses. In the deep drawing process a flat trimmed sheet metal part, the blank, is inserted into a conventional forming tool and deformed by elongation and compression in a cavity. In the case of large area sheet metal parts that are fabricated thus it has been demonstrated that in particular a slight arch renders the central region of its surface area relatively weak. Hence these large area sheet metal parts exhibit only slight resistance to buckling.

Furthermore, there exists hydromechanical deep drawing (hydromech process) for the manufacture of sheet metal parts. In this process no die impression is required, rather the drawing punch moves the clamped blank into an active medium (water) filled vessel that replaces the die impression. The water pressure causes the sheet metal to adapt to the shape of the drawing punch. In a variant of this process, the clamped blank is freely prestretched before the actual shaping deformation process in order to obtain increased ironing and thus greater strength in the blank center. To date this process has required complicated and thus expensive equipment; and the cycle times are longer compared to those of the deep drawing process.

The object of the invention is to provide a process for the manufacture of large area sheet metal parts from a flat blank. Said process makes it possible to reduce the cycle times while raising the buckling resistance in the center of the blank.

The invention solves this problem with a process for the manufacture of a large area sheet metal part, in particular a body component for a vehicle, from a flat blank, characterized in that one sided pressurization with an active medium in a forming tool gives the flat blank a prestretched preform, and that then the preform, removed from the forming tool, is formed into the final shape in a separate deep drawing tool. Other advantageous features of the invention are disclosed herein and in the claims.

The primary advantages of the invention lie in the fact that by combining for the first time two known processes, namely prestretching of an initially flat blank with an active medium to cold harden in particular the blank center and the conventional pressing (deep drawing) of sheet metal parts, one can profit from the advantages of both processes—optimal component properties and high process efficiency.

The prestretched sheets can be manufactured on systems with relatively low shear forces, since the maximum required pressure is approx. 15 bar. Furthermore, mechanical pressing can be used. The high pressure, which is required for conventional hydromechanical final forming and which in turn results in high press closing forces, is not necessary for the inventive process, since the final forming is done here conventionally. Since prestretching consumes very little time, as compared to the hydromechanical final forming, the cycle time for the process of the invention is significantly reduced.

The manufacture of prestretched sheet metal can be conceived as a first operation in an interconnected press train. Moreover, it is conceivable that the semifinished product manufacturer delivers to the pressing works already prestretched blanks (comparable to tailored blanks).

The use of tailored blanks is also conceivable for further reducing the weight. In this case a reinforcement, especially, e.g., in the region of the thinner sheet, can be used for locally increasing the resistance to buckling (example floor panel, tunnel, floor panel).

Prestretched blanks can also be used in soft tools, which are commonly used in prototyping. To date it was not possible to deform hydromechanically produced parts with so-called soft tools on account of the pressure that was generated.

Suitable components are all parts of the exterior skin. In addition, it seems logical to use the aforementioned process combination for all surface components, which are manufactured in any event from relatively thin sheet metal.

The inventive process can result in higher component strength, which in turn offers a potential weight reduction through the use of thinner sheet metal without having to accept the past drawbacks of hydromechanically formed sheets—very high process cycle time and high system costs. Cycle times, comparable to the conventional sheet forming processes, can be targeted. The preformed blanks can be produced separately, for example, at the semi-finished product manufacturer. Thus, it is also possible to apply the process to prototype components, since the cost is virtually neutral.

One embodiment of the invention is depicted in the drawings and is explained in detail in the description.

DETAILED DESCRIPTION OF THE DRAWINGS

Figure 1A:
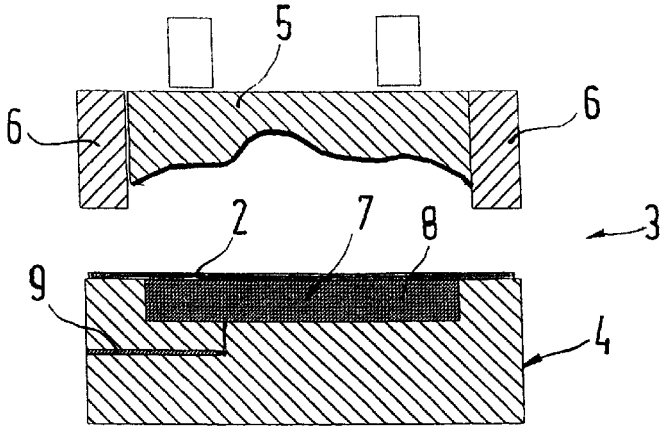
FIG. 1A depicts an open forming tool with inserted flat blank, where the die impression exhibits a profiled shape.

To manufacture a large area sheet metal part 1, in particular a body component for a vehicle, a flat blank 2 is first made by trimming or punching. This blank 2 is then inserted into a forming tool 3, which comprises a stationary bottom member 4 and an upper moveable die impression 5. Blank holders 6 are spaced apart and connected to the die impression 5. When the forming tool 3 is closed, the blank holders press against the top side of the blank 2 and thus move it into the correct position in the forming tool 3.

As evident from FIG. 1A, there is a cavity 7 in the bottom part 4, adjacent to the blank 2, for an active medium 8. The cavity 7 is provided with a feed and drain line 9 for the active medium 8. Preferably a liquid (water, oil or the like) is used as the active medium 8. Furthermore, the active medium 8 could also be designed pneumatically (e.g. air).

Figure 1B:
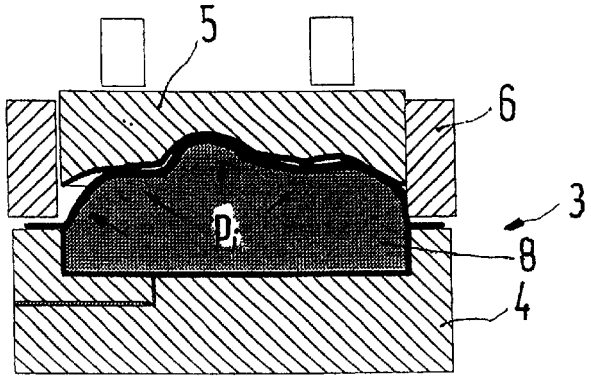
FIG. 1B depicts the closed forming tool with prestretched blank.
Figure 1C:
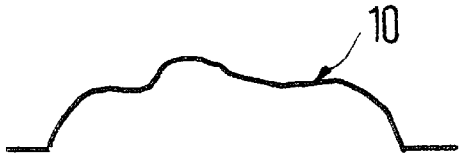
FIG. 1C depicts a removed prestretched sheet metal part.
Figure 1D:
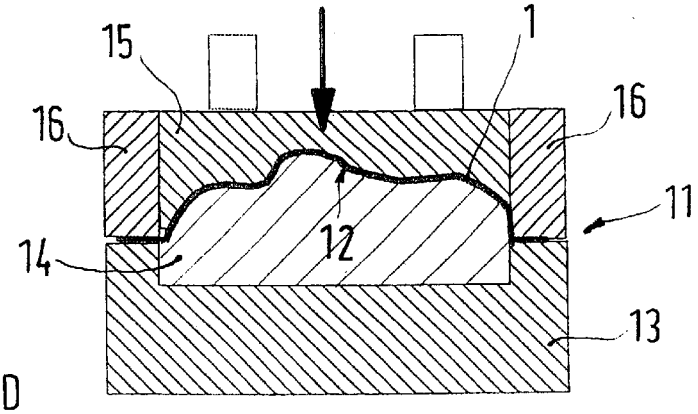
FIG. 1D depicts the sheet metal part, which is inserted into a conventional deep drawing tool and has already been formed into its final shape.

When the forming tool 3 is closed with the inserted blank 2, a pressure pi is built up by one-sided pressurization of the blank 2 with the active medium 8. In this manner the internal high pressure forming process gives the flat blank 2 a quasi prestretched preform 10. According to FIG. 1B, the bottom side of the impression die 5 exhibits a profiled shape. After opening the forming tool 3, the prestretched, profiled preform 10 is removed from the forming tool and inserted into a conventional multi-part deep drawing tool 11 and deformed there into its final shape 12 in a deep drawing process. The deep drawing tool 11 comprises a stationary bottom member 13 with an insert 14, which defines the final shape 12, a moveable upper member 15 and blank holders 16. The blank 2 can exhibit uniform wall thickness over the entire surface area. However, the blank 2 can also be designed as a tailored blank component.

Figure 2A:
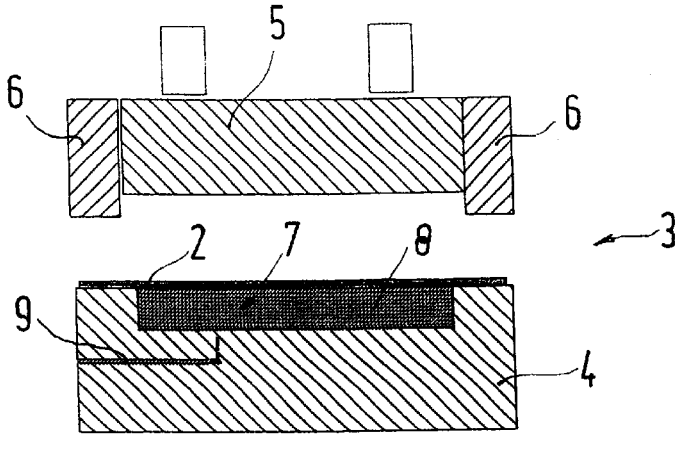
FIG. 2A depicts an open forming tool with inserted flat blank, where the die impression exhibits a flat shape.
Figure 2B:
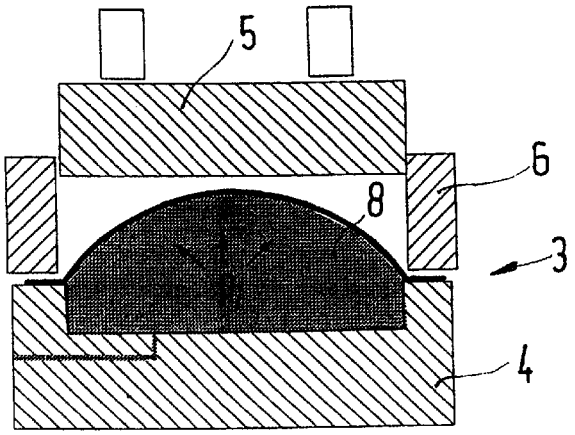
FIG. 2B depicts the closed forming tool with prestretched blank.
Figure 2C:
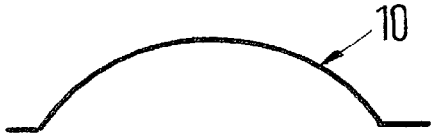
FIG. 2C depicts a removed prestretched sheet metal part.
Figure 2D:
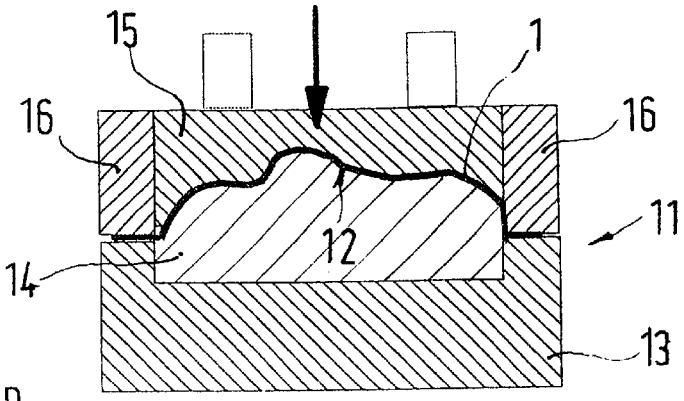
FIG. 2D depicts the sheet metal part, which is inserted into a conventional deep drawing tool and has already been formed into its final shape.

The embodiment, according to FIGS. 2A to 2B, differs from the first embodiment only in that, according to FIG. 2B, the horizontal underside of the die impression 5 is designed so as to exhibit a smooth surface. During pressurization with the active medium, the blank 2 assumes here, according to FIG. 2B, a preform 10, which is arched at the top. Then this preform 10 is formed into the final shape 12 in the deep drawing tool 11 (FIGS. 2C and 2D).

What is claimed is:

1. A process for manufacturing a large area sheet metal body component for a vehicle from a flat blank, comprising:

inserting the flat blank into a forming tool, producing a prestretched preform by pressurizing one side of the flat blank in the forming tool with an active medium, removing the prestretched preform from the forming tool, inserting the prestretched preform into a separate deep drawing tool, and deforming the prestretched preform by way of the separate deep drawing tool into its final shape.

2. The process as claimed in claim 1, wherein the active medium is a hydraulic or pneumatic active medium.

3. The process as claimed in claim 1, wherein the forming tool includes a die impression having a horizontal underside which is designed so as to exhibit a smooth surface.

4. The process as claimed in claim 1, wherein the forming tool includes a die impression which exhibits a profiled shape.

5. The process as claimed in claim 1, wherein the blank is a tailored blank.

6. The process according to claim 1, wherein the large area sheet metal body component for the vehicle is an automobile body part.

7. The process as claimed in claim 1, wherein said body component is a vehicle roof.

8. The process as claimed in claim 1, wherein said body component is an outside door panel of the vehicle.

9. The process as claimed in claim 1, wherein said body component is an outside cover plate of the vehicle.

10. The process as claimed in claim 1, wherein said body component is a vehicle floor panel.

11. A process of making a large area sheet metal vehicle body part, comprising:

inserting a flat blank in a forming tool, using fluid pressurization on one side of the flat blank to form a preform, and subsequently further forming the preform into a final shape in a separate deep drawing press tool.

12. The process of making a large area sheet metal vehicle body part according to claim 11, wherein the sheet metal vehicle body part is an automobile body part.

13. The process as claimed in claim 11, wherein said vehicle body part is a roof.

14. The process as claimed in claim 11, wherein said vehicle body part is an outside door panel.

15. The process as claimed in claim 11, wherein said vehicle body part is an outside cover plate.

16. The process as claimed in claim 11, wherein said body component is a vehicle floor panel.

17. An apparatus for making a large area sheet metal vehicle body part, comprising:

a first forming tool operable to preform a flat sheet metal blank into a preform using one sided fluid pressurization to impress the flat sheet metal blank against a preform die impression, and a second separate forming tool configured as a deep drawing press and operable to further deform the preform to a final shape.

18. The apparatus as claimed in claim 17, wherein said vehicle body part is a roof.

19. The apparatus as claimed in claim 17, wherein said vehicle body part is an outside door panel.

20. The apparatus as claimed in claim 17, wherein said vehicle body part is an outside cover plate.

21. The apparatus as claimed in claim 17, wherein said body component is a vehicle floor panel.

* * * * *